US008833082B2

(12) United States Patent
Borre et al.

(10) Patent No.: US 8,833,082 B2
(45) Date of Patent: Sep. 16, 2014

(54) NATURAL DRAFT CONDENSER

(75) Inventors: Gweneal Vanden Borre, Etterbeek (BE); Michel Vouche, Brussels (BE); Marc Cornelis, Ghent (BE); Francis Badin, Binche (BE); Benoit Thiry, Brussels (BE)

(73) Assignee: SPX Cooling Technologies, Inc., Overland Park, KS (US)

( * ) Notice: Subject to any disclaimer, the term of this patent is extended or adjusted under 35 U.S.C. 154(b) by 272 days.

(21) Appl. No.: 13/286,538

(22) Filed: Nov. 1, 2011

(65) Prior Publication Data

US 2012/0103570 A1 May 3, 2012

Related U.S. Application Data

(60) Provisional application No. 61/409,666, filed on Nov. 3, 2010.

(51) Int. Cl.
*F01K 9/02* (2006.01)
*F28B 3/00* (2006.01)
*F28B 1/06* (2006.01)

(52) U.S. Cl.
CPC ..... *F28B 1/06* (2013.01)
USPC ..... 60/692; 60/693; 165/113; 165/157; 165/173

(58) Field of Classification Search
USPC ..... 60/692–694; 165/110–113, 157, 165/172–173, 185, DIG. 182; 261/30, 64, 261/108, 109, DIG. 11, DIG. 76, DIG. 87
See application file for complete search history.

(56) References Cited

U.S. PATENT DOCUMENTS

| | | | | | |
|---|---|---|---|---|---|
| 3,406,747 | A | | 10/1968 | White | |
| 3,498,590 | A | | 3/1970 | Furlong | |
| 3,776,306 | A | * | 12/1973 | Michel | 165/111 |
| 3,844,344 | A | * | 10/1974 | Kliemann et al. | 165/110 |
| 3,851,702 | A | * | 12/1974 | Heller et al. | 165/110 |
| 3,880,964 | A | * | 4/1975 | Fordyce et al. | 261/111 |
| 3,888,305 | A | | 6/1975 | Gerz | |
| 3,903,212 | A | | 9/1975 | Lefevre | |
| 4,164,256 | A | * | 8/1979 | Kelp | 165/125 |
| 4,243,095 | A | | 1/1981 | Kosten | |
| 4,397,793 | A | * | 8/1983 | Stillman et al. | 261/30 |
| 5,156,706 | A | * | 10/1992 | Sephton | 159/47.1 |

OTHER PUBLICATIONS

International Search Report for International Application No. PCT/US2011/058763 dated Mar. 2, 2012.

* cited by examiner

*Primary Examiner* — Hoang Nguyen
(74) *Attorney, Agent, or Firm* — Baker & Hostetler LLP

(57) ABSTRACT

A system for condensing steam includes a steam supply duct, a supply riser, a supply manifold, a pair of condensing panels, a return manifold, and a condensate return. The steam supply duct is configured to convey steam from a steam generator. The supply riser is configured to convey steam from the steam supply duct. The supply manifold is configured to convey steam from the supply riser. The pair of condensing panels is configured to receive steam from the supply manifold. The supply manifold bifurcates with each bifurcation being configured to supply a respective condensing panel of the pair of condensing panels. The return manifold is configured to receive condensate from the pair of condensing panels. The condensate return duct is configured to convey condensate from the return manifold to the steam generator.

20 Claims, 12 Drawing Sheets

NATURAL DRAFT CONDENSER

CROSS-REFERENCE TO RELATED APPLICATIONS

This application claims priority to U.S. Provisional Application Ser. No. 61/409,666, filed on Nov. 3, 2010, the disclosure of which is incorporated herein by reference in its entirety.

FIELD OF THE INVENTION

The present invention generally relates to a condenser. More particularly, the present invention pertains to a natural draft condenser.

BACKGROUND OF THE INVENTION

Many types of industrial facilities, such as for example, steam power plants, require condensation of the steam as integral part of the closed steam cycle. Both wet and dry type cooling towers have been used for condensing purposes. As wet cooled systems consume a considerable amount of cooling water dry cooling systems have gained a growing market share because of their ability to save water resources. In particular, forced draught dry air-cooled condensers consisting of a multitude of fin tube heat exchangers have been known for many years. Contrary to wet cooling arrangements which are characterized by a secondary cooling water loop these systems are so-called "direct" dry systems where steam is directly condensed in the fin tube heat exchangers by air cooling. The fin tube heat exchangers are mounted with the tube center lines arranged in a position inclined to the vertical direction. The bundles are mounted to a support structure which enables cooling air to be conveyed through the fin tube heat exchangers by means of fans. Ambient air in contact with the fin tube heat exchangers condenses the steam inside the fin tubes, which then exits the heat exchanger as condensed sub-cooled liquid. Although being commercially successful over many years a disadvantage of direct dry air-cooled condensers is the power required to operate the fans, as well as fan noise which is undesirable in most situations. Currently 2 types of dry cooling are used, ACC fan assisted, and IDCT natural draft or fan assisted Another type of system is the so-called "indirect" dry cooling system. In such a system, a turbine exhaust condenser is provided, where turbine steam is condensed by means of cooling water. The cooling water is conveyed through a water duct by means of a pump to an air-cooled cooling tower which may be of wet or dry type. In the case of dry type the cooling tower consists of a multitude of air-cooled heat exchangers where the heat is rejected to the ambient air by convection. The cooling tower may be operated with fan assistance or in natural draught. The turbine exhaust condenser may for example be a surface or a jet condenser. Because of the presence of a secondary water loop, indirect dry cooling systems are not as thermally effective as direct dry systems. Another disadvantage of natural draught indirect dry cooling systems, however, is the higher investment cost as compared to the forced draught direct air cooled condenser.

Vacuum steam condensers are characterized by ingress of ambient air (inert gas or non-condensables). If not completely withdrawn from the heat exchangers this air will reduce the exchanger efficiency considerably because non-condensables will accumulate and create "air pockets" within the finned tubes. Consequently, effective heat exchange surface and condenser performance will be reduced. Therefore, vacuum condensers are provided with a secondary condenser arranged in reflux mode where the inert gases are extracted from the top exchanger headers of the secondary condenser bundles by special evacuation means. To safeguard that all inert gases are conveyed to these secondary condenser top headers the secondary condenser tube bundles must always be properly supplied by cooling air. Due to local fluctuations of ambient air caused by wind or other reasons natural draught cooled systems may in some instances not be able to maintain permanent secondary condenser cooling while some primary condenser sections are still cooled. This may not only lead to accumulation of inert gases and performance reduction, but also to increase of tube side corrosion as well as the danger of tube side freezing under frost conditions. As long as proper evacuation of the heat exchanger bundles is not guaranteed under all operating conditions the combination of dry condensation and natural draught cooling—although being discussed for some time—poses non-accountable risks to the operator of such equipment.

Accordingly, it is desirable to provide a condenser, condenser system and method of condensing water vapor that is capable of overcoming the disadvantages described herein at least to some extent.

SUMMARY OF THE INVENTION

The foregoing needs are met, to a great extent, by the present invention, wherein in some respects a condenser, condenser system and method of condensing water vapor is provided.

An embodiment of the present invention pertains to a system for condensing steam. The system for condensing steam includes a steam supply duct, a supply riser, a supply manifold, a pair of condensing panels, a return manifold, and a condensate return. The steam supply duct is configured to convey steam from a steam generator. The supply riser is configured to convey steam from the steam supply duct. The supply manifold is configured to convey steam from the supply riser. The pair of condensing panels is configured to receive steam from the supply manifold. The supply manifold bifurcates with each bifurcation being configured to supply a respective condensing panel of the pair of condensing panels. The return manifold is configured to receive condensate from the pair of condensing panels. The condensate return duct is configured to convey condensate from the return manifold to the steam generator.

Another embodiment of the present invention relates to a system for condensing steam. The system includes a supply manifold, a first pair of self-standing condensing panels, and a second pair of self-standing condensing panels. The supply manifold conveys steam from a steam supply. The first pair of self-standing condensing panels is configured to receive steam from the supply manifold. The supply manifold bifurcates with each bifurcation being configured to supply a respective condensing panel of the first pair of condensing panels. The second pair of self-standing condensing panels is disposed upon the first pair of self-standing condensing panels. The first pair of self-standing condensing panels is configured to support the second pair of self-standing condensing panels.

Yet another embodiment of the present invention pertains to an apparatus for dissipating waste heat. The apparatus includes a means for fabricating a pair of rectangular condensing panels. Each of the pair of rectangular condensing panels includes a respective top edge, bottom edge, and a pair of side edges. The apparatus further includes a means for affixing a first side edge of the first condensing panel to a first side edge of the second condensing panel to form a "V" shaped first self-standing condensing unit. In addition, the apparatus includes a means for disposing a second self-standing condensing unit atop the first self-standing condensing unit to form a self-standing condensing assembly.

Yet another embodiment of the present invention relates to a method of fabricating a condenser for dissipating waste heat. In this method, a pair of rectangular condensing panels is fabricated. Each of the pair of rectangular condensing panels includes a respective top edge, bottom edge, and a pair of side edges. In addition, a first side edge of the first condensing panel is affixed to a first side edge of the second condensing panel to form a "V" shaped first self-standing condensing unit. Furthermore, a second self-standing condensing unit is disposed atop the first self-standing condensing unit to form a self-standing condensing assembly.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in various embodiments, a condenser system and method of condensing steam suitable for use with a power generating facility. It is an advantage of one or more embodiments of the invention that supply ducting may be reduced relative to conventional condenser systems which results in a commensurate reduction in capital expenditures and upkeep. It is another advantage of one or more embodiments of the invention that return ducting may be reduced relative to conventional condenser systems which results in a commensurate reduction in capital expenditures and upkeep. It is yet another advantage of one or more embodiments of the invention that support structures associated with supporting condenser tubing, supply and return ducting may be reduced relative to conventional condenser systems which results in a commensurate reduction in capital expenditures and upkeep.

Figure 1:
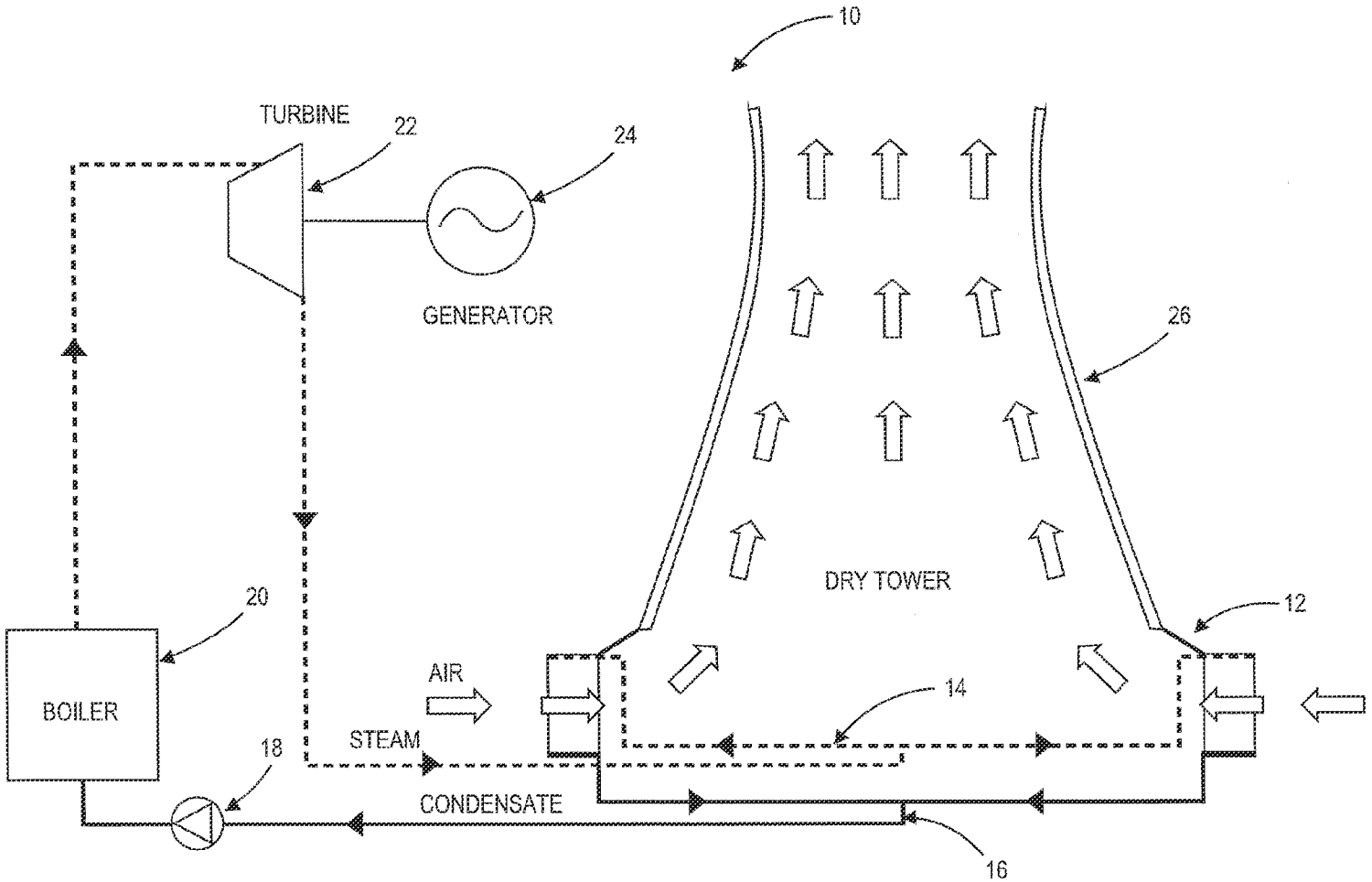
FIG. 1 is a simplified system diagram of a power generating facility with a condenser system according to an embodiment of the invention.

Preferred embodiments of the invention will now be described with reference to the drawing figures, in which like reference numerals refer to like parts throughout. FIG. 1 is a simplified system diagram of a power generating facility 10 with a condenser system 12 according to an embodiment of the invention. As shown in FIG. 1, the condenser system 12 includes a supply system 14 and return system 16. In a particular example, the supply system 14 supplies waste steam from a power generating system and the return system 16 returns condensed water back to the power generating system via a pump 18 (for example). While the particulars of the power generating system are well known to those skilled in the art, the power generating system generally includes a boiler 20 to generate steam which is utilized to drive a turbine 22 coupled to a generator 24.

Waste heat, in the form of steam (for example) is supplied to the condenser system 12 and, as shown in FIG. 1, this heat raises the temperature of air within a tower 26. The warmed air rises within the tower 26 which draws air from the base of the tower 26 through the condenser system 12. In this manner, a natural draft is established and maintained to remove heat from steam and/or condensate within the condenser system 12.

Figure 2:
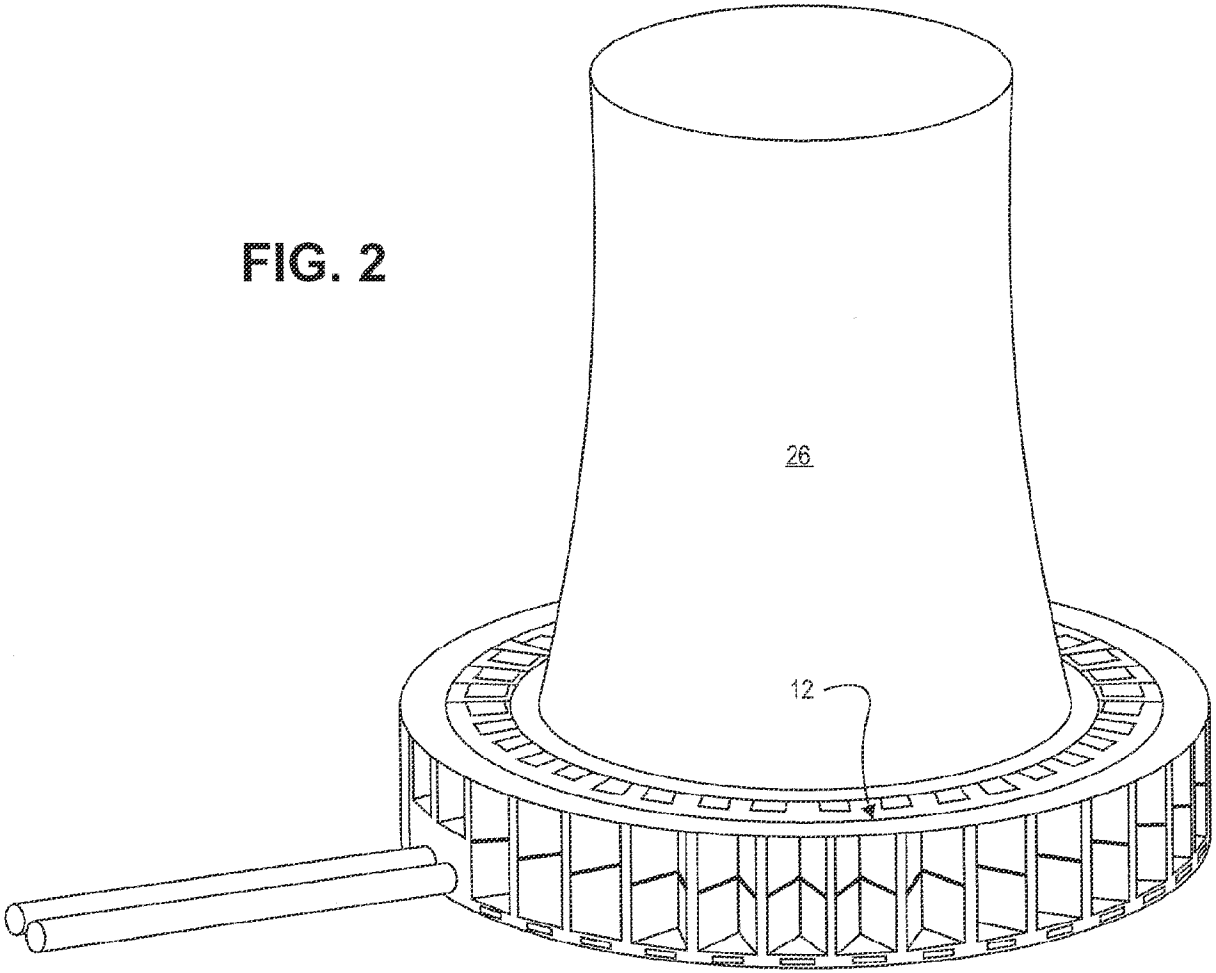
FIG. 2 is a solid model projection of cooling tower suitable for use with the condenser system of FIG. 1.

FIG. 2 is a solid model projection of the cooling tower 26 suitable for use with the condenser system 12 of FIG. 1. As shown in FIG. 2, the condenser system 12 is disposed in an annular ring about the base of the tower 26. In a particular example, the condenser system 12 may include a crenulated annular ring. This crenulation may provide an increased surface area relative to a non-crenulated condenser system 12. For the purpose of this disclosure, the term 'crenulated' and derivations thereof refers to an outline that is irregular, wavy, serrated, and/or the like.

Figure 3:
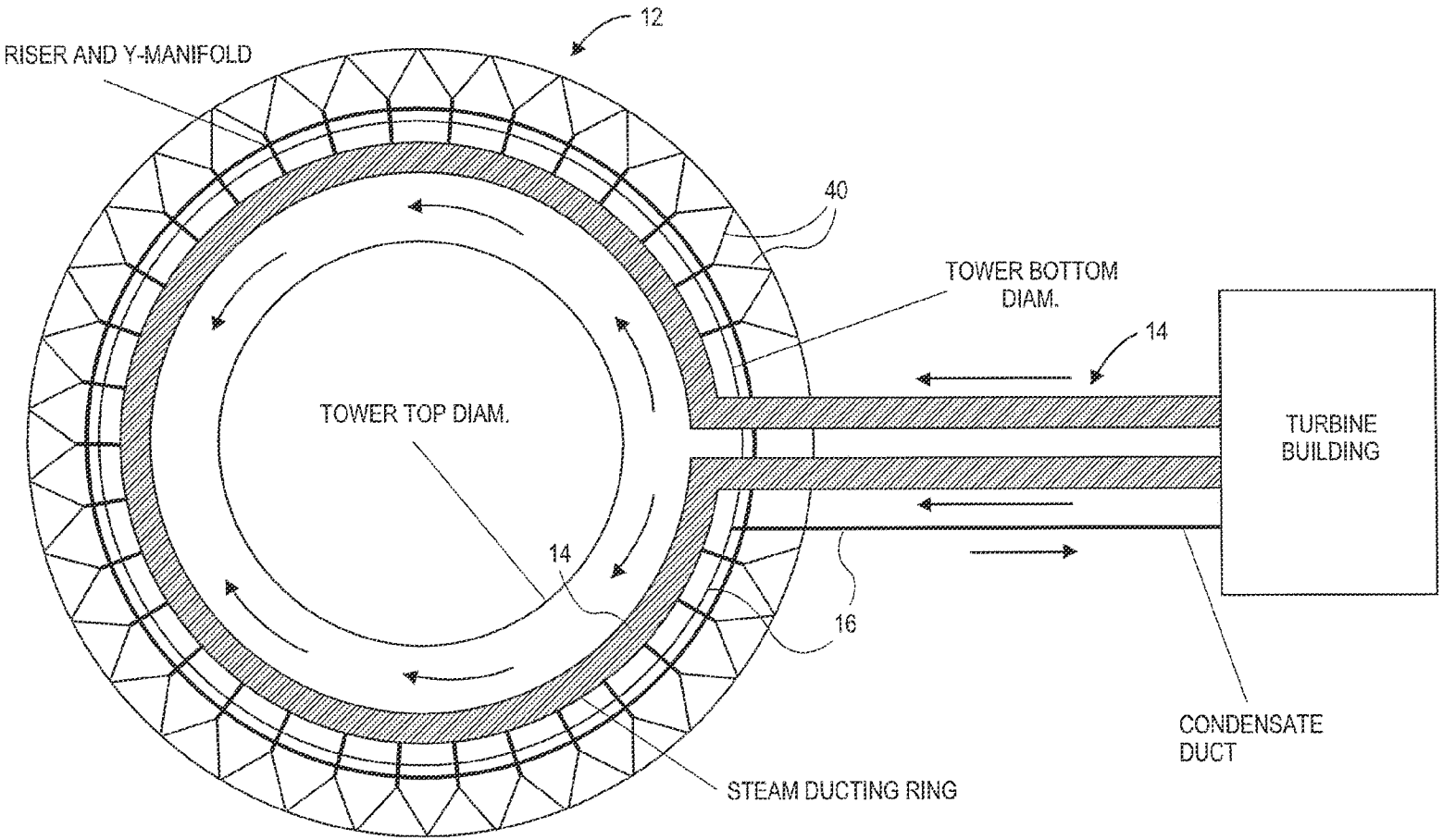
FIG. 3 is a top view of the condenser system of FIG. 1.

FIG. 3 is a top view of the condenser system 12 of FIG. 1. As shown in FIG. 3, the supply system 14 and return system 16 are annular rings disposed within a plurality of panels or bundles 40 that are disposed in a crenulated pattern about the base of the tower 26 (shown in FIG. 2). As described herein, these bundles 40 may include a panel of tubes with the tubes being separated by a space sufficient for a flow of air to pass therethrough.

Figure 4:
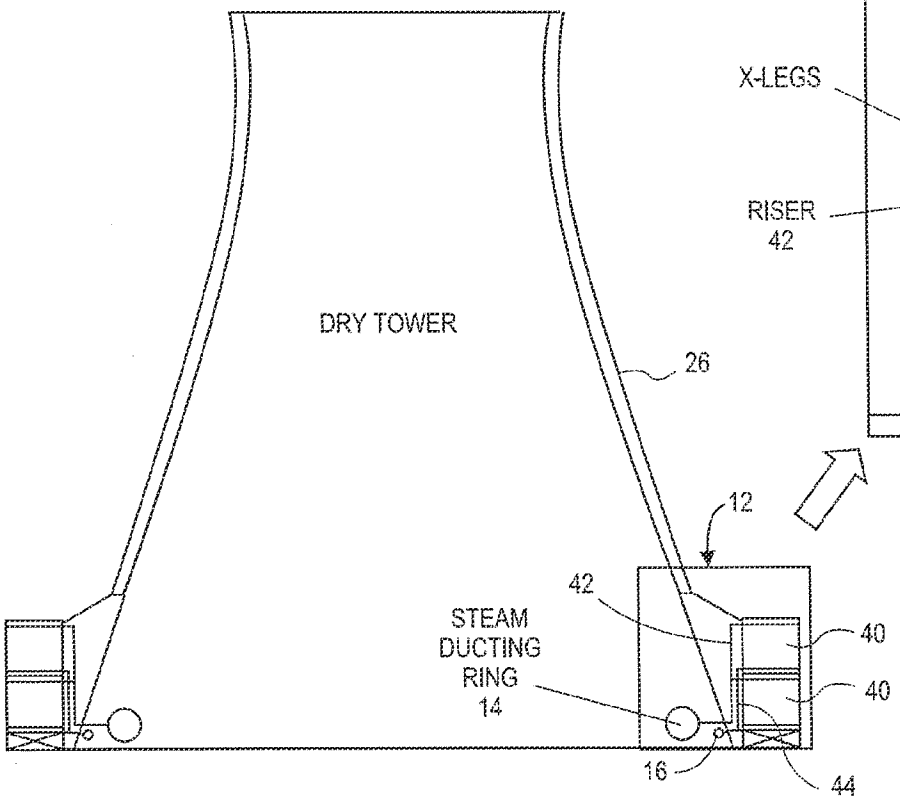
FIG. 4 is a cross sectional view of the cooling tower of FIG. 2.

FIG. 4 is a cross sectional view of the cooling tower 26 according to FIG. 2. As shown in FIG. 4, the condenser system 12 may include a plurality of bundles 40 stacked one upon the other. In this manner a length of tubing within the bundles 40 may be sized appropriately. That is, in some examples, it may be thermodynamically beneficial to have a relatively short length of tubing. In such an example, to increase the overall ability to remove heat, two or more additional bundles may be stacked up. To supply steam to the stacked bundles 40, the condenser system 12 may include a supply riser 42. To return condensate to the return system 16, the condenser system 12 may include a return piping 44.

Figure 5:
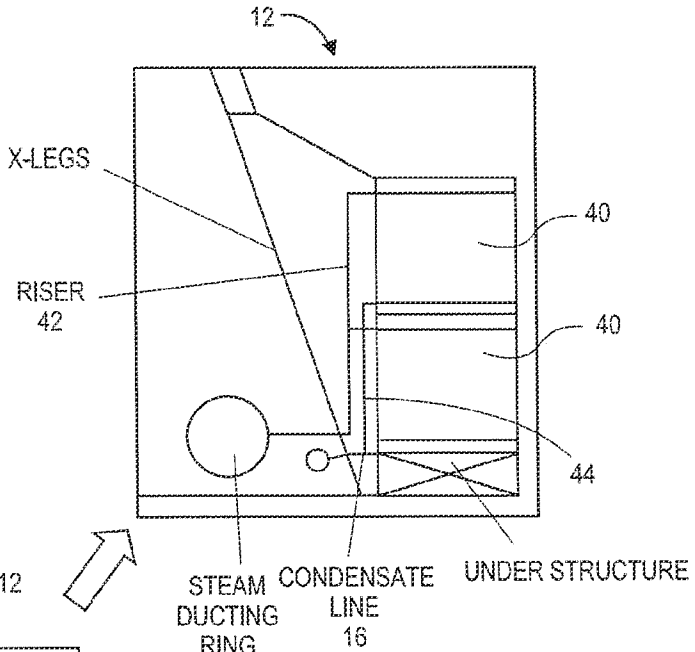
FIG. 5 is a more detailed cross sectional view of the condenser system of FIG. 4.

FIG. 5 is a more detailed cross sectional view of the condenser system 12 of FIG. 4. As shown in FIG. 5, the supply riser 42 is configured to provide steam to a top portion of the bundle 40. Also shown in FIG. 5, the return piping 44 is configured to provide an outlet for condensate from a lower portion of the bundle 40. It is an advantage of this and other embodiments that the lower bundle 40 provides support for the upper bundle 40. As such, little or no additional support structure is required which provides a commensurate reduction in costs. In a particular example, tubes within the bundles 40 may be disposed vertically within the bundles 40 and may include a relatively strong material having good thermal conductivity such as seamless refined copper or the like.

Figure 6:
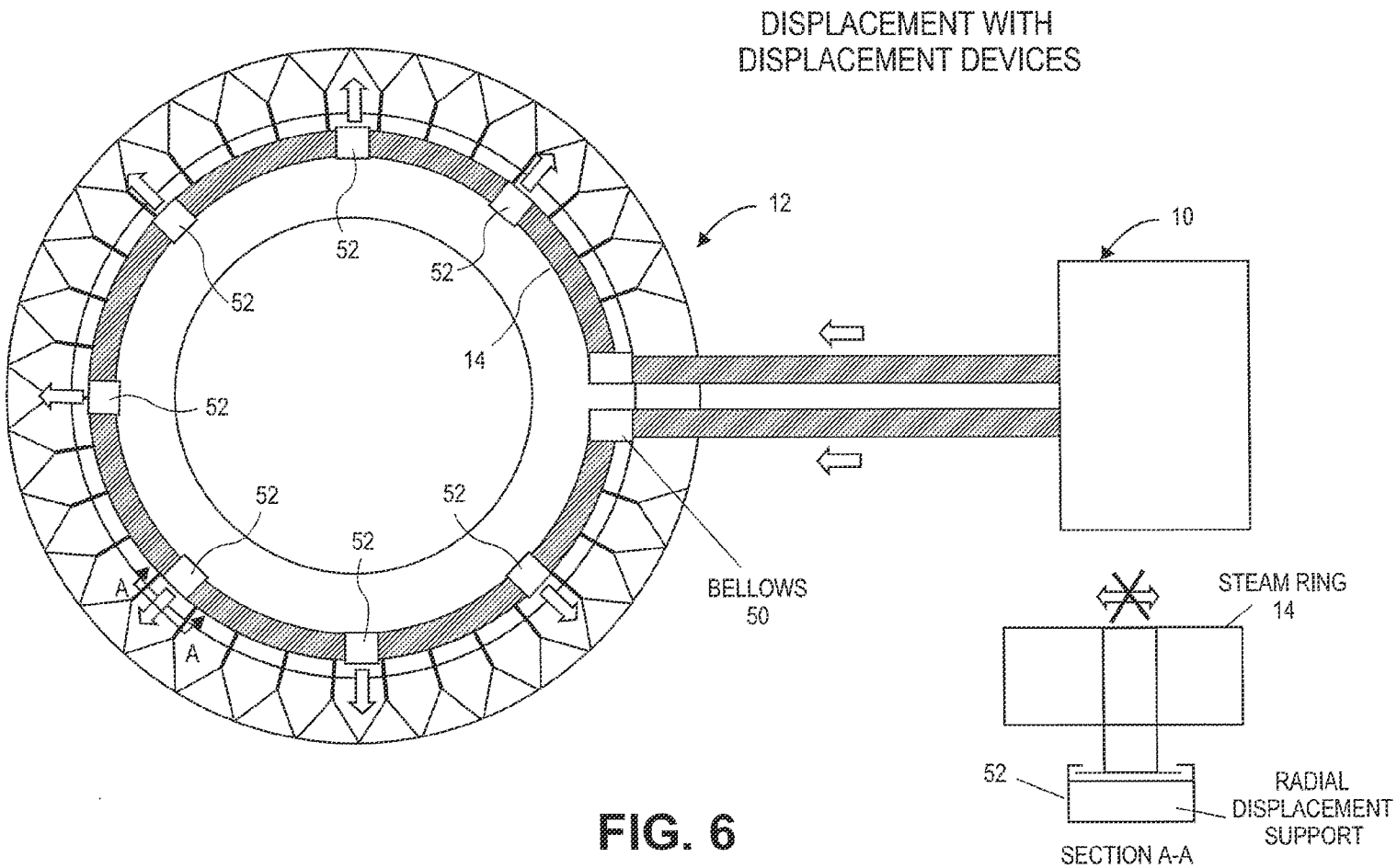
FIG. 6 is a simplified top view of a displacement device suitable for use with the condenser system of FIG. 1.

FIG. 6 is a simplified top view of a displacement device 50 suitable for use with the condenser system 12 of FIG. 1. As shown in FIG. 6, the displacement device 50 is configured to facilitate expansion/contraction of the supply system 14. For example, ducting from the power generating facility 10 may expand as it is heated by the steam. This expansion, if not controlled for, may cause stress or damage to the condenser system 12. To control for this expansion or displacement, the displacement device 50 may be configured to allow one portion of the supply system 14 to move relative to another portion of the supply system 14. In a particular example, a sliding sleeve, bellows, or the like may provide this displacement capacity.

Also shown in FIG. 6, radial displacement devices 52 may be disposed about the supply system 14 to facilitate expansion/contraction due to temperature fluctuations.

Figure 7:
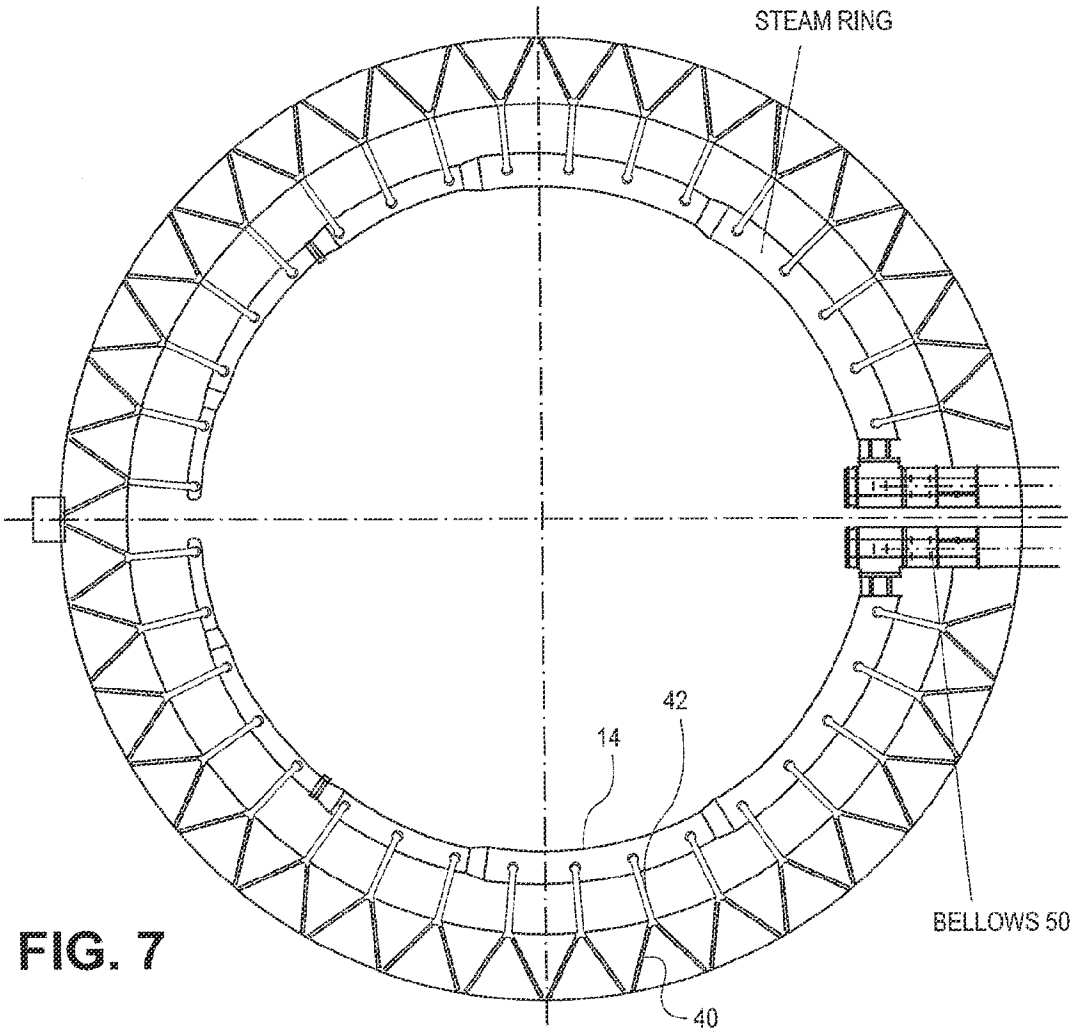
FIG. 7 is a more detailed top view of the displacement device suitable for use with the condenser system of FIG. 6.

FIG. 7 is a more detailed top view of the displacement device suitable for use with the condenser system of FIG. 6. As shown in FIG. 7, the supply system 14 may be configured as a pair of semi-circular ducts that taper in diameter towards a distal end of the supply system 14. In this manner, the pressure and/or velocity of steam within the supply system 14 may remain relatively constant throughout the supply system 14 ducting.

Figure 8:
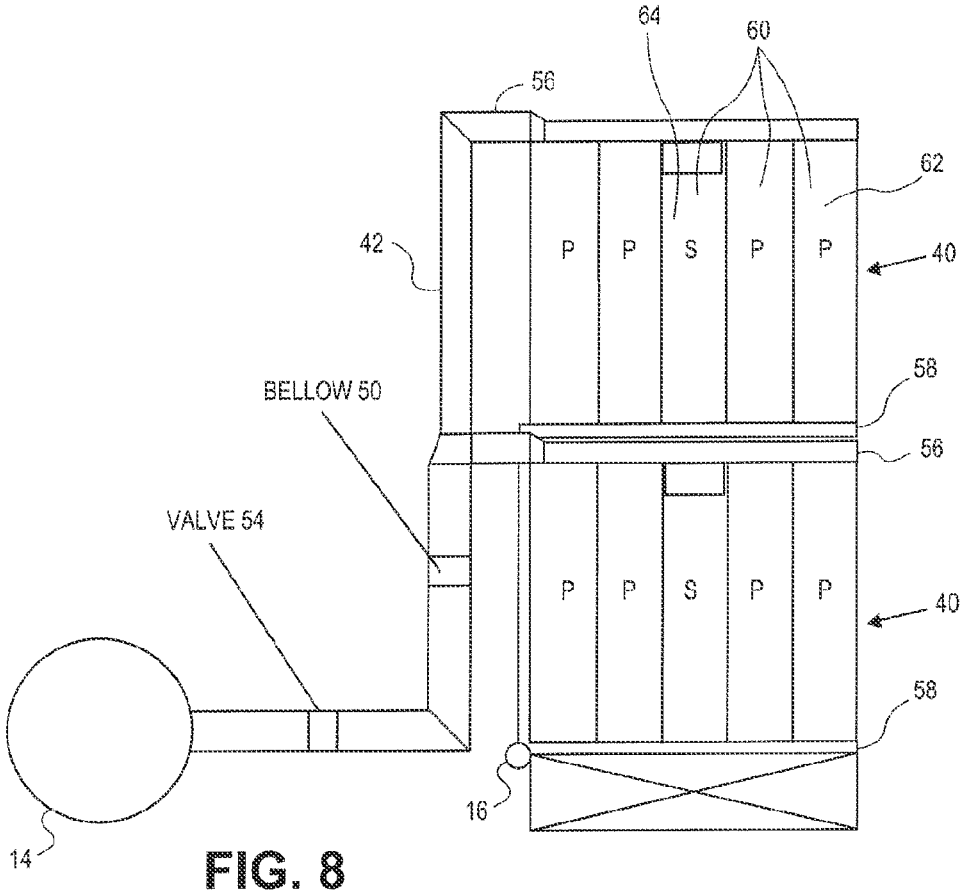
FIG. 8 is a side view of the displacement device suitable for use with the condenser system of FIG. 1.

FIG. 8 is a side view of the displacement device 50 suitable for use with the condenser system 12 of FIG. 1. As shown in FIG. 8, the supply riser 42 may include a displacement device 50 configured to facilitate expansion/contraction of the supply riser 42. In addition, the supply riser 42 may include a valve 54 configured to modulate flow of steam within the supply riser 42. Also shown in FIG. 8, the condenser system 12 may include a supply manifold 56 configured to distribute steam from the supply riser 42 across the bundle 40. Similarly, the condenser system 12 may include a return manifold 58 configured to collect from the bundle 40. In a particular example shown in FIG. 8, the bundle 40 includes a plurality of pipe assemblies 60. Each pipe assembly 60 may include one or more pipes generally arranged in a line. This plurality of pipe assemblies 60 may include a set of primary pipe assemblies 62 and one or more secondary pipe assemblies 64.

The primary pipe assemblies 62 are configured to receive steam from the supply manifold 56, transfer heat from the steam to air flowing around the pipes, and convey condensate down to the return manifold 58. The secondary pipe assemblies 64 are included in any air-cooled condenser design. The function is to provide a means to capture and extract any non-condensable gases that may be contained in the steam. The secondary pipe assemblies 64 are not connected to the steam supply at the top, but are connected to the condensate line. Non-condensable gases are configured to flow into these bundles through the condensate line and be extracted using a vacuum system connect to the top of the secondary pipe assemblies 64.

More generally, the bundle 40 is configured as a panel of vertical tubes. In the following description, example will be made of the supply manifold, however, because the return manifold 58 is similar to the supply manifold 56, duplicative description of the return manifold will be omitted for the sake of brevity.

Figure 9:
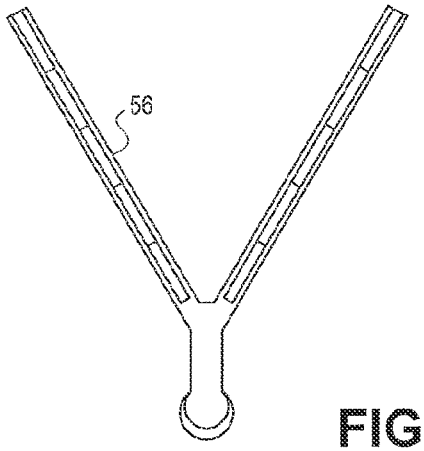
FIG. 9 is a top view of a Y supply manifold for the condenser system of FIG. 1.

FIG. 9 is a top view of a Y supply manifold 56 for the condenser system 12 of FIG. 1. As shown in FIG. 9, the supply manifold 56 is configured as a "Y" to distribute the steam from the supply riser 42 to the pipes within the pipe assemblies 40.

Figure 10:
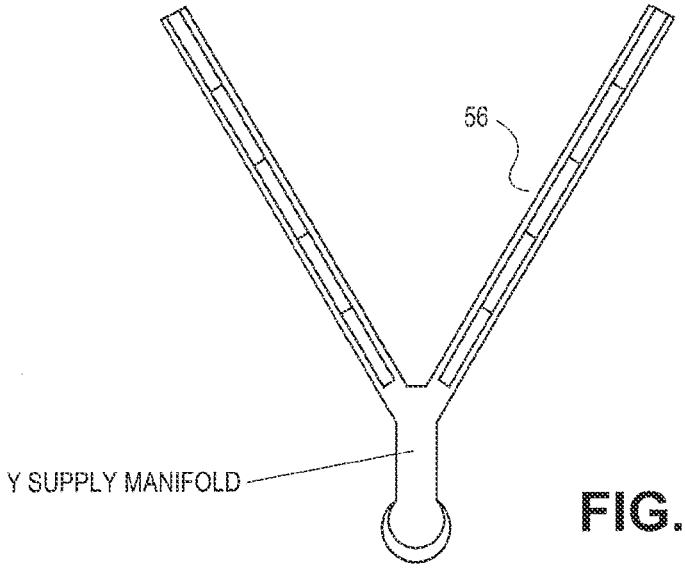
FIG. 10 is a top view of the Y supply manifold for the condenser system of FIG. 1.
Figure 11:
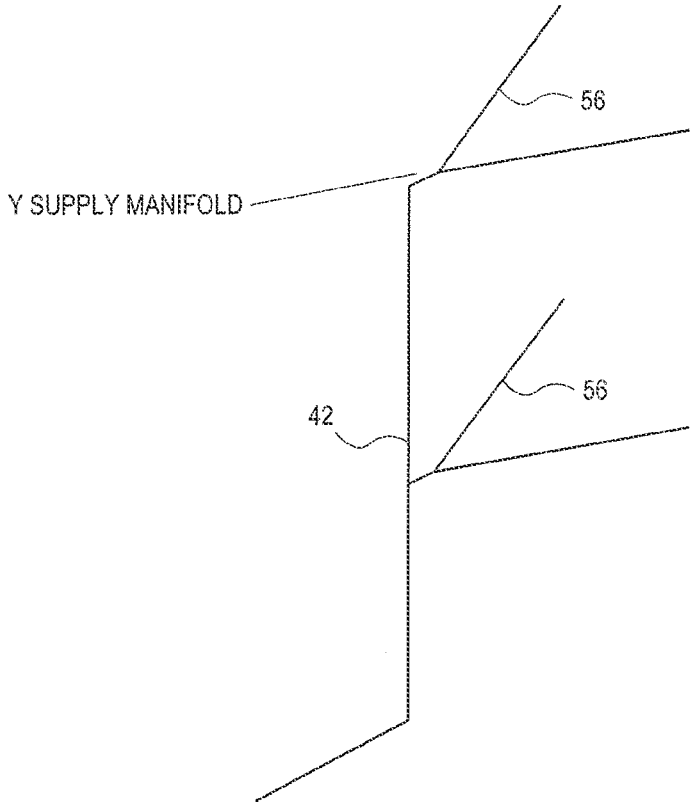
FIG. 11 is an isometric view of the Y supply manifold for the condenser system of FIG. 1.

FIG. 10 is a top view of the Y supply manifold 56 for the condenser system 12 of FIG. 1. FIG. 11 is an isometric view of the Y supply manifold 56 for the condenser system 12 of FIG. 1. As shown in FIG. 11, the supply riser 42 includes a plurality of supply manifolds 56 with one supply manifold 56 for each respective bundle 40.

Figure 12:
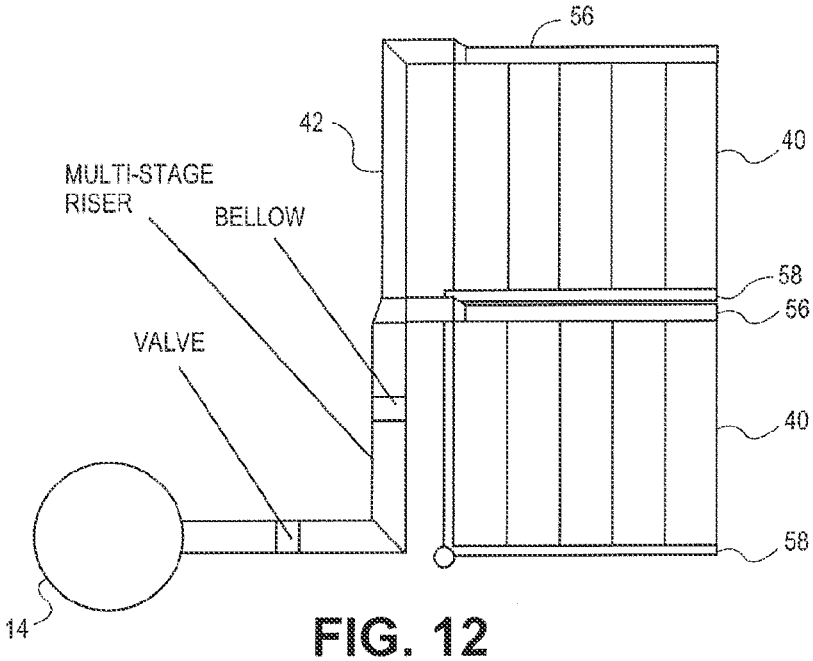
FIG. 12 is a side view of the supply system suitable for use with the condenser system of FIG. 1.
Figure 13:
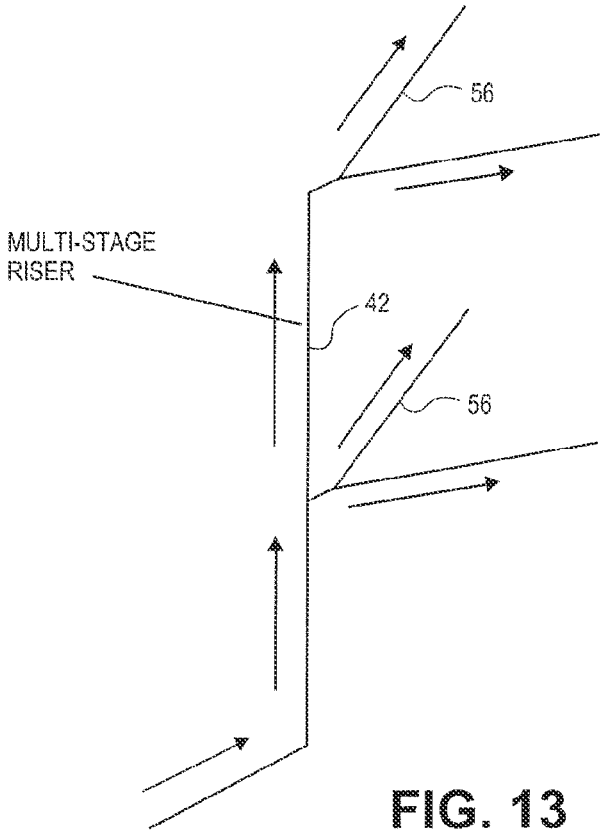
FIG. 13 is an isometric view of the Y supply manifold for the condenser system of FIG. 13.

FIG. 12 is a side view of the supply system 14 suitable for use with the condenser system 12 of FIG. 1. FIG. 13 is an isometric view of the Y supply manifold 56 for the condenser system 12. As shown in FIG. 13, steam flows up through the riser 42 into the respective supply manifolds 56 whereupon the flow of steam bifurcates to supply two bundles 40 with steam.

Figure 14:
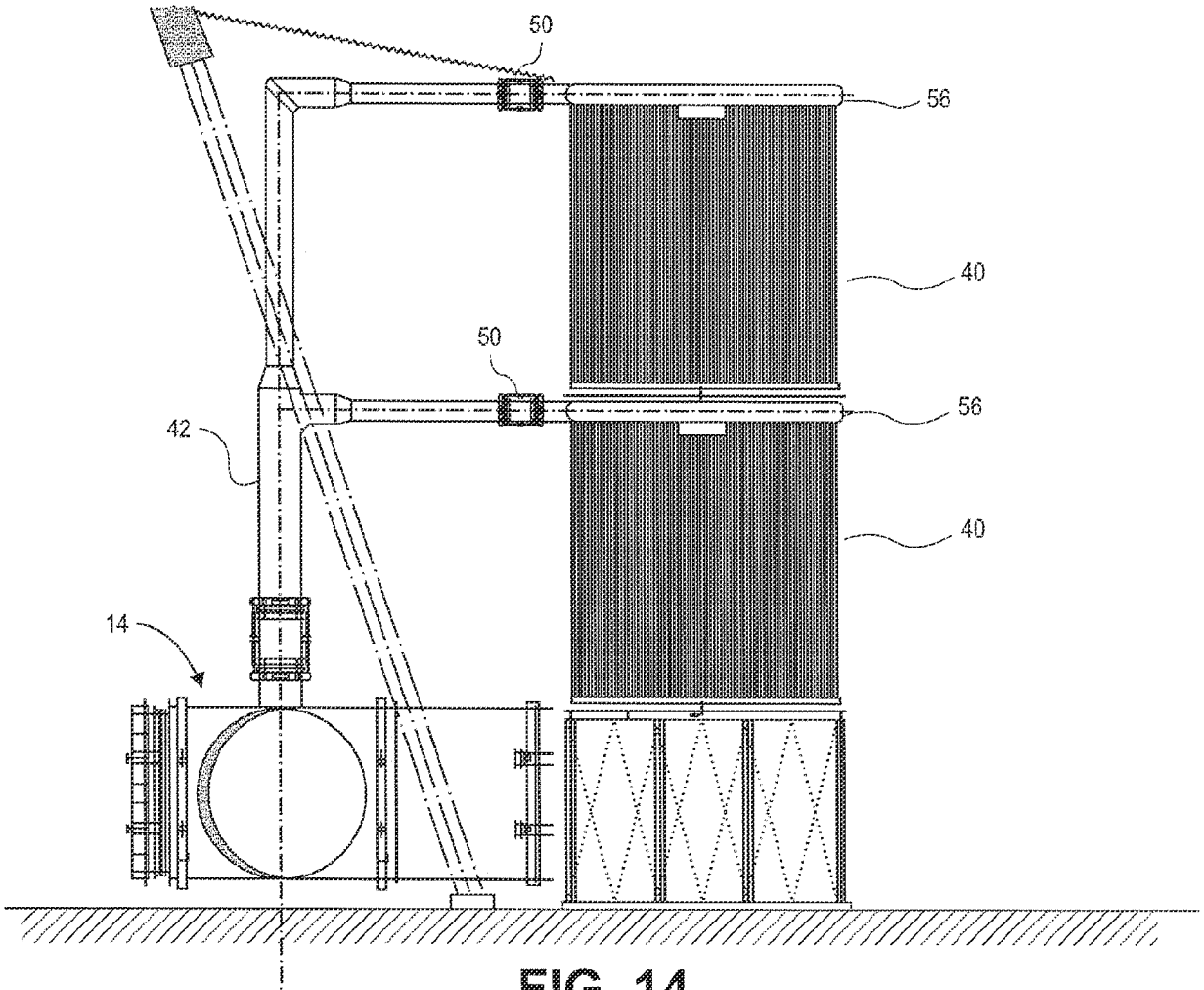
FIG. 14 is a cross sectional view of the displacement device suitable for use with a condenser system according to another embodiment.

FIG. 14 is a cross sectional view of the displacement device 50 suitable for use with a condenser system 12 according to another embodiment. As shown in FIG. 14, the supply riser 42 may include a respective displacement device for each supply manifold 56.

Figure 15:
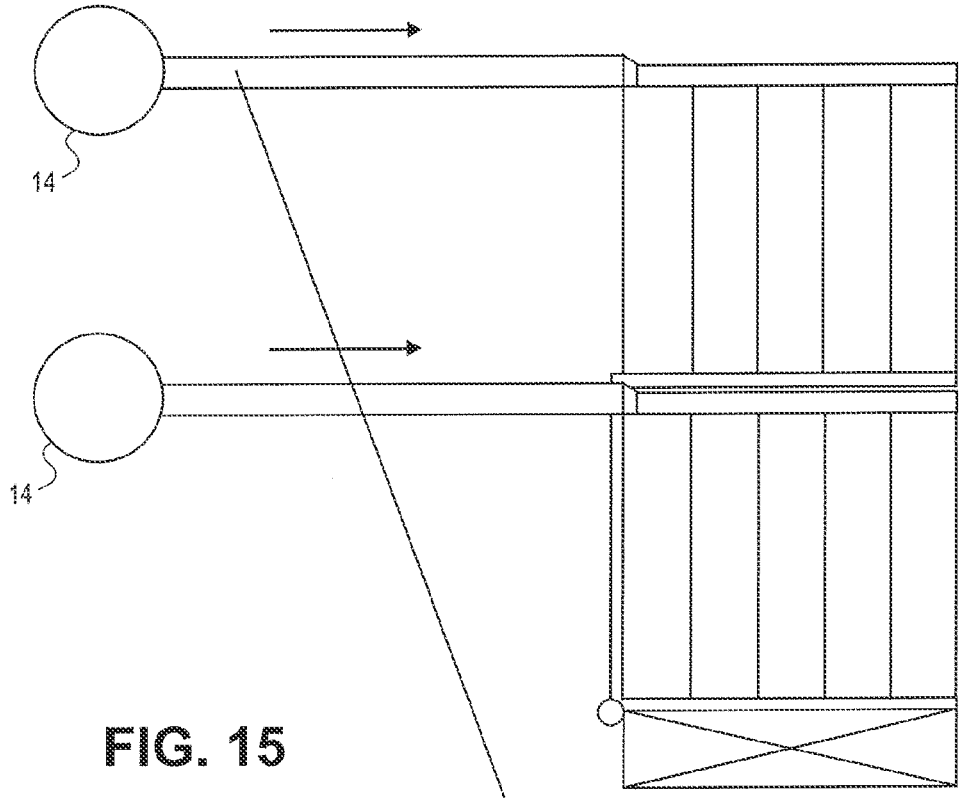
FIG. 15 is a simplified top view of a condenser system according to yet another embodiment.

FIG. 15 is a simplified top view of a condenser system 12 according to yet another embodiment. As shown in FIG. 15, the condenser system 12 may include a supply system 14 with a plurality of annular rings with one annular supply ring for each layer of bundles 40. In a particular example, the condenser system 12 may include a pair of annular rings or a pair of matched semi-circular ducts (for a total of four semi-circular ducts).

Figure 16:
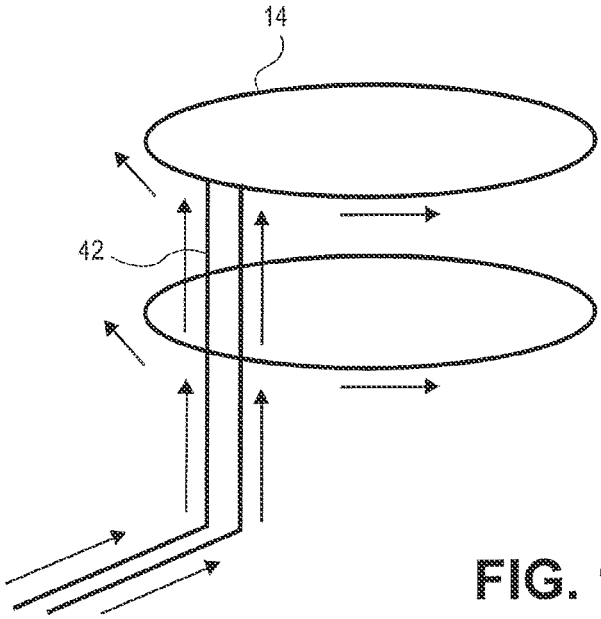
FIG. 16 is an isometric view of a supply manifold for the condenser system of FIG. 15.

FIG. 16 is an isometric view of a supply manifold for the condenser system of FIG. 15. As shown in FIG. 16, the flow of steam may be configured to rise within the supply riser 42 and annularly about the condenser system 12.

Figure 17:
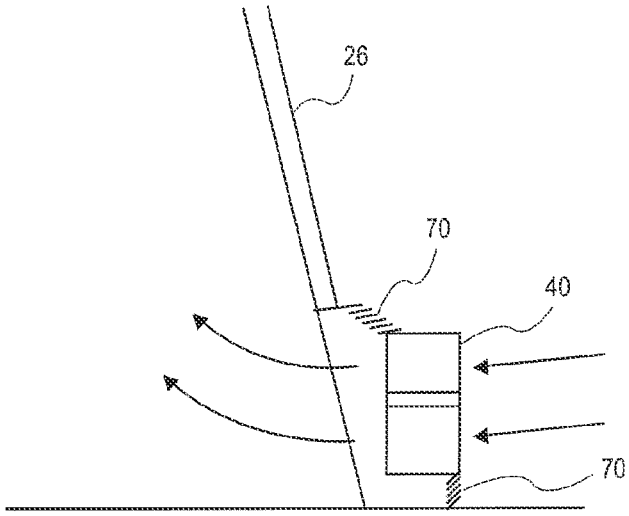
FIG. 17 is a simplified cross sectional view of the condenser system 12 of FIG. 1.
Figure 18:
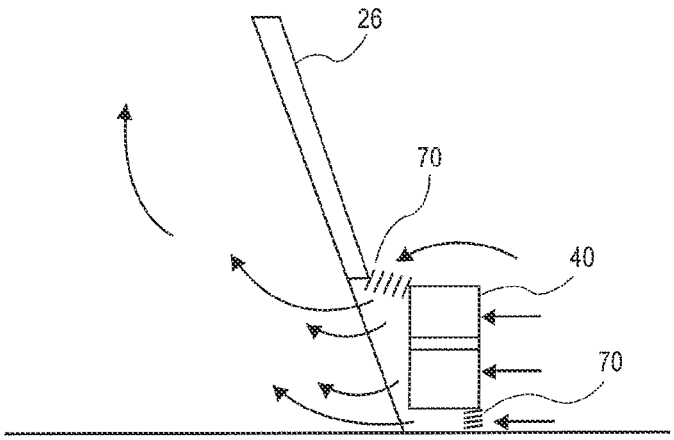
FIG. 18 is a simplified cross sectional view of the condenser system 12 of FIG. 1.

FIGS. 17 and 18 are simplified cross sectional views of the condenser system 12 of FIG. 1. As shown in FIGS. 17 and 18, the condenser system 12 optionally includes one or more louvers 70 that may be closed (as shown in FIG. 17) to facilitate increased airflow through the bundles 40 by reducing bypass airflow from entering the tower 26. The louvers 70 may be opened (as shown in FIG. 18) to increase the amount of bypass air entering the tower 26 and thereby reducing the airflow through the bundles 40.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for condensing steam, the system comprising:

a supply manifold to convey steam from a steam supply;

a first pair of self-standing condensing panels configured to stand without a supporting structure, the first pair of self-standing condensing panels being configured to receive steam from the supply manifold, wherein the supply manifold bifurcates with each bifurcation being configured to supply a respective condensing panel of the first pair of condensing panels; and a second pair of self-standing condensing panels configured to stand without a supporting structure, the second pair of self-standing condensing panels being configured disposed upon the first pair of self-standing condensing panels, wherein the first pair of self-standing condensing panels is configured to support the second pair of self-standing condensing panels.

2. The system according to claim 1, further comprising:

a flow of cooling fluid configured to flow through the first pair of self-standing condensing panels and the second pair of self-standing condensing panels.

3. The system according to claim 2, further comprising:

a natural draft tower configured to supply the flow of cooling fluid.

4. The system according to claim 3, further comprising:

a crenulated ring disposed about a base of the natural draft tower, the crenulated ring including a plurality of the first pair of self-standing condensing panels and a plurality of the second pair of self-standing condensing panels.

5. The system according to claim 2, further comprising:

a set of louvers to modulate a bypass flow, wherein the flow of cooling fluid flowing through the first pair of self-standing condensing panels and the second pair of self-standing condensing panels is inversely affected by the bypass flow.

6. The system according to claim 1, further comprising:

a boiler configured to generate the steam supply; and a pump to urge a condensate to flow from the first pair of self-standing condensing panels and the second pair of self-standing condensing panels to the boiler.

7. The system according to claim 6, further comprising:

a turbine configured to generate power in response to receiving the steam from the boiler.

8. The system according to claim 1, further comprising:

a bellows disposed in the supply manifold between the steam supply and the first and second pair of self-standing condensing panels.

9. A system for condensing steam, the system comprising:

a steam supply duct to convey steam from a steam generator;

a supply riser to convey steam from the steam supply duct;

a supply manifold to convey steam from the supply riser;

a pair of condensing panels configured to stand without a supporting structure, the pair of condensing panels being configured to receive steam from the supply manifold, wherein the supply manifold bifurcates with each bifurcation being configured to supply a respective condensing panel of the pair of condensing panels;

a return manifold to receive a condensate from the pair of condensing panels; and a condensate return duct to convey condensate from the return manifold to the steam generator.

10. The system according to claim 9, further comprising:

a natural draft tower configured to generate a flow of air in response to steam being supplied to the pair of condensing panels.

11. The system according to claim 10, further comprising:

a crenulated ring disposed about a base of the natural draft tower, the crenulated ring including a plurality of the pair of condensing panels.

12. The system according to claim 10, further comprising:

a set of louvers to modulate a bypass air flow, wherein the flow of air flowing through the pair of condensing panels is inversely affected by the bypass air flow.

13. The system according to claim 9, further comprising:

a boiler to generate the steam; and a pump configured to urge the condensate to flow from the return manifold to the boiler.

14. The system according to claim 13, further comprising:

a turbine configured to generate power in response to receiving the steam from the boiler.

15. The system according to claim 9, further comprising:

a bellows disposed in the supply manifold between the steam supply and the pair of condensing panels.

16. An apparatus for dissipating waste heat, the apparatus comprising:

means for fabricating a pair of rectangular condensing panels configured to stand without a supporting structure, each of the pair of rectangular condensing panels including a respective top edge, bottom edge, and a pair of side edges;

means for affixing a first side edge of the first condensing panel to a first side edge of the second condensing panel to form a "V" shaped first self-standing condensing unit; and means for disposing a second self-standing condensing unit atop the first self-standing condensing unit to form a self-standing condensing assembly.

17. The apparatus according to claim 16, further comprising:

means for fabricating a crenulated ring comprising a plurality of the self-standing condensing assemblies.

18. A method of fabricating a condenser for dissipating waste heat, the method comprising the steps of:

fabricating a pair of rectangular condensing panels, each of the pair of rectangular condensing panels including a respective top edge, bottom edge, and a pair of side edges;

affixing a first side edge of the first condensing panel to a first side edge of the second condensing panel to form a "V" shaped first self-standing condensing unit configured to stand without a supporting structure; and disposing a second self-standing condensing unit configured to stand without a supporting structure, the second self-standing condensing unit being disposed atop the first self-standing condensing unit to form a self-standing condensing assembly configured to stand without a supporting structure.

19. The method according to claim 18, further comprising the step of:

fabricating a crenulated ring comprising a plurality of the self-standing condensing assemblies.

20. The method according to claim 19, further comprising the step of:

supplying steam from a supply manifold to each of the condensing panels of the crenulated ring.

* * * * *